US005778992A

United States Patent [19]

Fuller

[11] Patent Number: 5,778,992

[45] Date of Patent: Jul. 14, 1998

[54] DRILLING ASSEMBLY FOR DRILLING HOLES IN SUBSURFACE FORMATIONS

[75] Inventor: John Michael Fuller, Nailsworth, England

[73] Assignee: Camco Drilling Group Limited of Hycalog, Stonehouse, England

[21] Appl. No.: 733,060

[22] Filed: Oct. 16, 1996

[30] Foreign Application Priority Data

Oct. 26, 1995 [GB] United Kingdom ..... 9521972

[51] Int. Cl.[6] ..... E21B 7/06

[52] U.S. Cl. ..... 175/73; 175/95; 175/406

[58] Field of Search ..... 175/73, 61, 107, 175/95, 96, 325.1, 101, 104, 406

[56] References Cited

U.S. PATENT DOCUMENTS

| | | | |
|---|---|---|---|
| 3,743,034 | 7/1973 | Bradley | 175/61 |
| 3,888,319 | 6/1975 | Bourne, Jr. et al. | 175/76 |
| 4,040,495 | 8/1977 | Kellner et al. | 175/73 |
| 4,185,704 | 1/1980 | Nixon | 175/76 |
| 4,262,758 | 4/1981 | Evans | 175/73 |
| 4,305,474 | 12/1981 | Farris et al. | 175/73 |
| 4,635,736 | 1/1987 | Shirley | 175/76 |
| 4,637,479 | 1/1987 | Leising | 175/61 X |
| 5,113,953 | 5/1992 | Noble | 175/61 |
| 5,265,682 | 11/1993 | Russell et al. | 175/73 X |
| 5,311,952 | 5/1994 | Eddison et al. | 175/61 |
| 5,314,030 | 5/1994 | Peterson et al. | 175/61 X |
| 5,343,964 | 9/1994 | Leroy | 175/61 |
| 5,452,772 | 9/1995 | Van Den Bergh | 175/107 X |
| 5,485,889 | 1/1996 | Gray | 175/61 |
| 5,490,569 | 2/1996 | Brotherton et al. | 175/61 |
| 5,520,255 | 5/1996 | Barr et al. | 175/24 |
| 5,547,031 | 8/1996 | Warren et al. | 175/61 |

FOREIGN PATENT DOCUMENTS

| | | |
|---|---|---|
| 0015137 | 9/1980 | European Pat. Off. . |
| 1514895 | 10/1989 | U.S.S.R. . |
| 2259316 | 3/1993 | United Kingdom . |
| 2306528 | 5/1997 | United Kingdom . |
| 9007625 | 7/1990 | WIPO . |

*Primary Examiner*—Hoang C. Dang

[57] ABSTRACT

A drilling assembly for drilling holes in subsurface formations comprises a drill bit 10, a drive unit 12 including a housing and a rotor 11 operatively coupled to the drill bit to rotate the drill bit relative to the housing, and a modulated bias unit 14 coupled to rotate with the drive unit housing and apply a lateral bias thereto in synchronism with rotation of the housing. The modulated bias unit 14 comprises one or more hydraulic actuators including members 16 which, in use, bear against the sides of the borehole, and means for modulating the pressure of fluid supplied to the actuators in synchronism with rotation of a component of the drilling assembly, and in selected angular phase relation thereto, whereby each hydraulic actuator is actuated in a selected rotational position of the component.

10 Claims, 1 Drawing Sheet

23
22
19
24
26
25
20
21
18

11
13
17
15

13
16
15
11
12
10
14

DRILLING ASSEMBLY FOR DRILLING HOLES IN SUBSURFACE FORMATIONS

BACKGROUND TO THE INVENTION

1. Field of the Invention

The invention relates to drilling assemblies for connection to a drill string for drilling holes in subsurface formations.

2. Description of Related Art

As is well known, in rotary drilling rotation is imparted to the drill bit by rotating from the surface a drill string to the lower end of which the drilling assembly is coupled. The drill bit may be controlled to drill in a required direction, for example as described in British Patent Specification No. 2259316, by coupling to the drill bit a modulated bias unit which applies a lateral displacement to the drill bit in a constant direction as the bit rotates. The modulated bias unit comprises one or more hydraulic actuators the supply of fluid under pressure to which is modulated in synchronism with rotation of the unit and bit, and in selected angular phase relation thereto, the phase relation determining the direction of the bias and hence the direction in which the bit is steered.

In motor drilling the drill bit is rotated by a downhole drive unit, such as a positive displacement motor or turbine. For the purposes of steering the drill bit, the drive unit may be a steerable motor having a bent housing or offset stabilizer, or the drive unit may be connected to the drill string by a device known as a bent sub, so that the bit axis is inclined to the axis of the lower end of the drill string. During unsteered drilling the drill string and drive unit are rotated so as to negate the effect of the bend, and when steering is required this rotation is stopped with the inclination of the bend pointing in the direction in which the drill bit requires to be steered. While steering, the orientation of the bend (or offset stabilizer), referred to as the "tool-face" angle, is monitored by a directional MWD system and controlled from the surface, initially by setting the orientation of the rotary table (then stationary). The tool-face angle is also influenced, through torsional strain, by torque in the drill string. Torque is dependent on weight on bit, and short term changes in measured tool-face angle are corrected by adjusting weight on bit. Tool-face angle and weight on bit are influenced by torque and drag due to friction between the drill string and the side of the hole. This influence makes steering difficult in long reach holes having high inclination in which much of the string weight is supported on the lower side of the hole. The extra length of the string adds to its angular and linear compliance, further increasing the influences of torque and drag. These difficulties are partly overcome by using extra care and by drilling slowly to minimise disturbances due to torque at the bit. Despite this, torque and drag effects do set a limit of reach beyond which steering by orienting becomes impracticable. These difficulties do not apply during unsteered drilling because the drill string is rotated continuously reducing drag and its effect on weight on bit, and also because there is then no need to control tool-face angle. Thus the loss of penetration rate while steering to make directional corrections increases as lateral reach is increased.

The present invention provides a downhole drilling assembly where the drill bit is rotated by a downhole drive unit, but where steering may be effected without the necessity of ceasing rotation of the drill string.

SUMMARY OF THE INVENTION

According to the invention there is provided a drilling assembly for drilling holes in subsurface formations, comprising a drill bit, a drive unit including a housing and a rotor operatively coupled to the drill bit to rotate the drill bit relative to the housing, and a modulated bias unit coupled to rotate with the drive unit housing and apply a lateral bias thereto in synchronism with rotation of the housing.

The modulated bias unit may comprise one or more actuators including members which, in use, may bear against the sides of the borehole, and means for modulating the force and/or motion of the actuators in synchronism with rotation of a component of the drilling assembly, and in selected angular phase relation thereto, whereby the, or each, actuator is actuated over a selected rotational range of said component.

The actuators of the modulated bias unit may comprise hydraulic actuators, said means for modulating the force and/or motion of the actuators comprising means for modulating the pressure and/or volume of fluid supplied to the actuators.

Examples of hydraulic and non-hydraulic modulated bias units are described in British Patent No. 2259316 and U.S. Pat. Nos. 5,113,953 and 3,743,034.

The drive unit may include fulcrum means which, in use, engage the walls of the borehole being drilled, the fulcrum means being located between the modulated bias unit and the drill bit whereby the lateral bias applied by the modulated bias unit causes the drive unit to pivot about the fulcrum means so as to apply to the drill bit a lateral bias in the opposite direction to the bias applied to the drive unit by the bias unit.

Alternatively, the actuators of the modulated bias unit may be located adjacent the drill bit so as to apply a lateral bias to the drill bit in the same direction as the lateral bias applied to the drive unit.

These last-mentioned arrangements thus permit steering of the drill bit while the drill string is rotating, reducing drag and avoiding the need to control motor orientation or tool-face angle by frequent monitoring and adjustments from the surface. Penetration rates may therefore be maintained even while steering is taking place.

Arrangements in accordance with the invention may be used with any downhole drilling assembly where the drill bit is rotated by a downhole drive unit and, in particular, it may employed in arrangements according to our co-pending Application Ser. No. 08/733,061 where the drill bit and the drive unit which rotates it are counter-rotating so as to reduce the net reaction torque transmitted to the drill string, as well as providing other benefits as referred to in that application.

Accordingly, in a drilling assembly, incorporating a modulated bias unit, in accordance with the present invention, the drill bit may carry cutters located and orientated to perform cutting action on the formation as the drill bit rotates anti-clockwise relative thereto, the rotor of the drive unit being operatively coupled to the drill bit to rotate the drill bit anti-clockwise relative to the housing of the drive unit, and a hole opener being coupled to the housing of the drive unit for rotation therewith.

In an alternative development of the present invention, according to said co-pending application, the rotor of the drive unit is operatively coupled to the drill bit to rotate the drill bit in one direction, e.g. anti-clockwise, relative to the housing of the drive unit, a hole opener is coupled to the housing of the drive unit for rotation therewith, and the rotor of a second drive unit is operatively coupled to the housing of the first drive unit to rotate the housing of the first drive unit in the opposite direction, e.g. clockwise, relative to the housing of the second drive unit.

In any of the arrangements according to the present invention the drill bit assembly may comprise part of a bottom hole assembly for connection to the drill string, the bottom hole assembly further including, for example, a thrust unit, one or more further hole openers, one or more stabilizers, or any other components of known kind which may be incorporated in a bottom hole assembly.

DETAILED DESCRIPTION OF THE PREFERRED EMBODIMENTS

Figure 1:
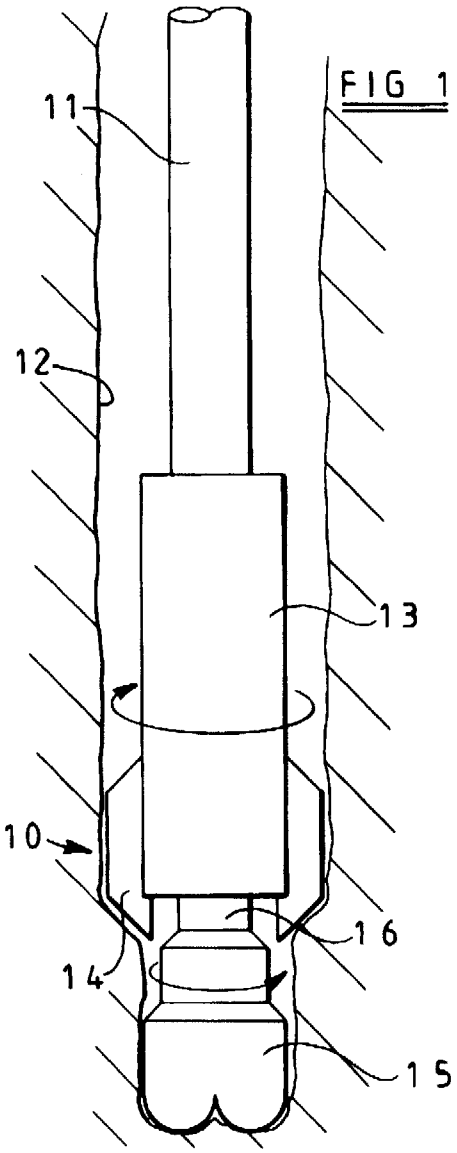
FIG. 1 is a diagrammatic side elevation of one form of drill bit assembly according to the invention, shown down a borehole.

Referring to FIG. 1: the drilling assembly comprises a drill bit 10 which is coupled, for example by a conventional tapered threaded pin connector, to the output shaft or rotor 11 of a drive unit 12. The drive unit 12 may be an hydraulically driven positive displacement motor or turbine, an electric motor, or any other suitable form of device for rotationally driving the drill bit.

Part way along the length of the housing of the drive unit 12 is mounted a stabilizer 13 which acts as a fulcrum device. The stabilizer may comprise a plurality of bearing elements spaced apart around the periphery of the drive unit housing.

The upper end of the housing of the drive unit 12 is directly coupled to the lower end of a modulated bias unit 14, the upper end of which is connected to the drill string 15.

The bias unit 14 may be of the basic kind described in British Specification No.2259316 where a plurality of hydraulic actuators are spaced apart around the periphery of the unit and have thrust members, one of which is indicated diagrammatically at 16, which may be extended to bear against the formation. A selector control valve modulates the supply of fluid under pressure to the actuators in synchronism with rotation of the bias unit, and in selected angular phase relation thereto, so as to extend and retract the thrust members 16 in succession as the bias unit rotates. The thrust members 16 are thus each extended at a selected rotational position of the bias unit and thereby apply a constant lateral displacement to the bias unit 14 as it rotates. As described in the above-mentioned specification, the bias unit is under the control of a control unit (not shown) which may comprise a roll stabilized instrument package connected to the drill string 15.

When the bias unit 14 is activated to initiate steering, the thrust members 16 are actuated to extend in succession, as the unit rotates, in the direction in which it is required that the borehole should deviate. Thus, as seen in FIG. 1, the thrust members 16 extend to the right and thereby maintain a constant displacement of the bias unit 14 to the left as it is rotated by the drill string 15.

This imparts a corresponding displacement to the left to the upper end of the housing of the drive unit 12 causing it to pivot anti-clockwise (as viewed in FIG. 1) about the fulcrum provided by the stabilizer 13, thus displacing the drill bit 10 to the right. The continuing rotation of the drill bit 10 by the drive unit 12 therefore causes the borehole to deviate to the right as drilling continues. While the bias is being maintained the drill string 15 continues to rotate, so that friction between it and the borehole is not increased and the rate of penetration is maintained. When steering is no longer required the bias unit 14 is de-activated so as no longer to apply a bias to the drive unit 12.

Figure 2:
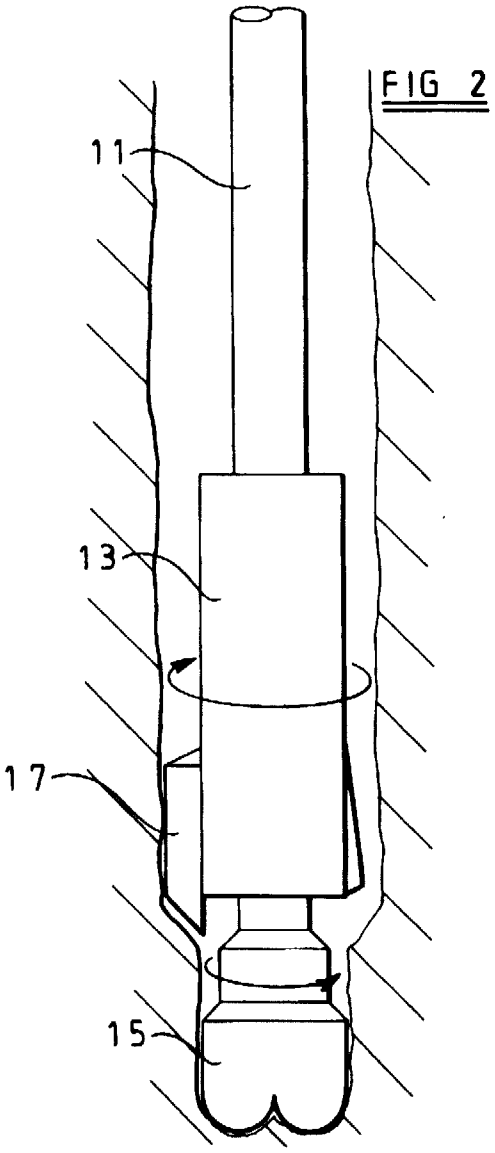

FIG. 2 shows a modified arrangement. In this case the thrust members 16 of the bias unit are located in an annular assembly 17 which surrounds the lower end of the drive unit 12 so as to be closer to the drill bit 10. The controlled fluid under pressure is delivered to the actuators from the control part 14 of the bias unit along conduits indicated diagrammatically at 18.

In this case a stabilizer 9 is mounted on the bias unit 14, and extension of the thrust members 16 in a constant lateral direction (to the left in FIG. 2) pivots the drive unit 12 and drill bit 10 anti-clockwise about the fulcrum provided by the stabilizer 9, displacing the drill bit to the right (as viewed in FIG. 2) so as to cause the borehole to deviate in that direction.

Either of the drilling assemblies shown in each of FIGS. 1 and 2 may be modified to incorporate the invention of British Application No. 9521944.0, whereby the drill bit 10 and drive unit 12 counter-rotate. Thus, in the case where the drill string 15 is rotated clockwise as viewed looking downhole, the drive unit 12 may be operated to rotate the drill bit 10 anti-clockwise relative to the housing of the drive unit.

British Patent Application No.9521944.0 also describes arrangements where counter-rotation is provided in systems where the drill string itself does not rotate. The present invention is equally applicable to such arrangements and a modification of such an arrangement, according to the present invention, is shown in FIG. 3.

In this case the drill bit 19 is operatively coupled to the output shaft or rotor 20 of a first drive unit 21. The rotor 20 rotates the drill bit 19 anti-clockwise relative to the housing of the drive unit. to Mounted on the housing of the first drive unit 21 is a lower hole opener 22 and an intermediate hole opener 23 which also serves as a fulcrum device. A modulated bias unit 24 is directly coupled to the upper end of the housing of the drive unit 21 and is operatively coupled to the output shaft or rotor 25 of a second drive unit 26. The housing of the drive unit 26 is coupled through a thruster 27 to the drill string 28 which may be of the type formed from coiled tubing.

The second drive unit 26, which remains non-rotating with the drill string 28 and thruster 27, rotates the bias unit 24 and the housing of the first drive unit 21 clockwise. The first drive unit 21 rotates the drill bit 19 anti-clockwise at a faster rate than the housing of the unit itself is rotated clockwise by the second drive unit 26, so that the drill bit 19 rotates anti-clockwise relative to the formation. The drill bit 19 may be a PDC drag-type drill bit, a roller cone bit, a diamond bit or a combination bit.

Figure 3:
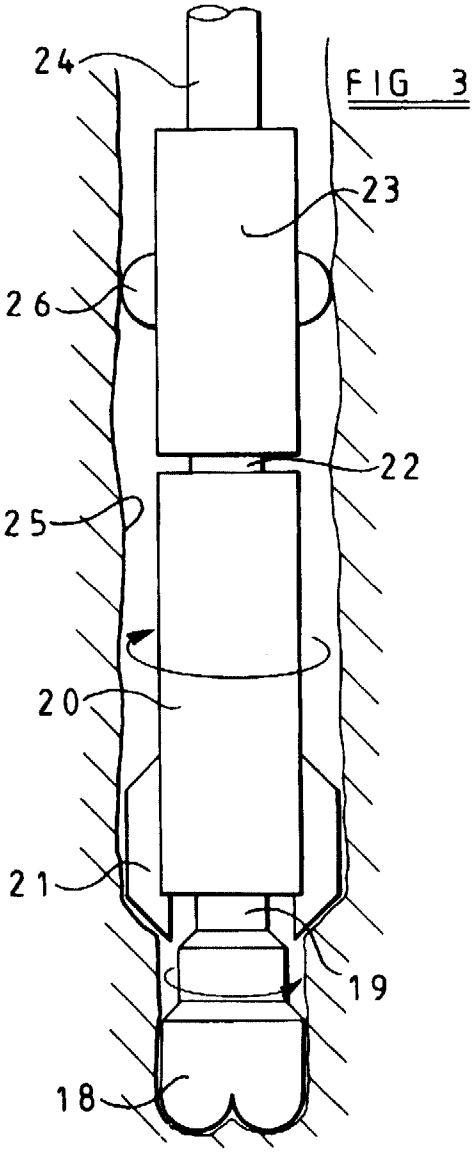
FIGS. 2 and 3 are similar views of alternative forms of drill bit assembly.

In the arrangement of FIG. 3 the bias unit 24, rotated by the drive unit 26, operates in similar manner to the bias unit 14 of the FIG. 1 arrangement, which is rotated directly by the drill string 15. Lateral extension of each thrust member 29 of the bias unit in a selected rotational position (to the right in FIG. 3) causes the bias unit and first drive unit 21 to pivot anti-clockwise about the fulcrum provided by the hole opener 23 so as to displace the drill bit 19 to the right and effect deviation of the borehole in that direction.

The arrangement of FIG. 3 thus provides both the steering advantages of the present invention with the advantages arising from counter-rotation of the drill bit and drive unit as outlined in British Patent Application No. 9521944.0.

Whereas the present invention has been described in particular relation to the drawings attached hereto, it should be understood that other and further modifications, apart from those shown or suggested herein, may be made within the scope and spirit of the present invention.

What is claimed:

1. A drilling assembly for drilling holes in subsurface formations, comprising a drill bit, a drive unit including a housing and a rotor operatively coupled to the drill bit to rotate the drill bit relative to the housing, and a modulated bias unit coupled to rotate with the drive unit housing and apply a lateral bias thereto in synchronism with rotation of the housing.

2. A drilling assembly according to claim 1, wherein the modulated bias unit comprises one or more actuators including members which, in use, bear against the sides of the borehole, and means for modulating the force and/or motion of the actuators in synchronism with rotation of a component of the drilling assembly, and in selected angular phase relation thereto, whereby the or each actuator is actuated over a selected rotational range of said component.

3. A drilling assembly according to claim 2, wherein the actuators of the modulated bias unit comprise hydraulic actuators, said means for modulating the force and/or motion of the actuators comprising means for modulating the pressure and/or volume of fluid supplied to the actuators.

4. A drilling assembly according to claim 1, wherein the drive unit include fulcrum means which, in use, engage the walls of the borehole being drilled, the fulcrum means being located between the modulated bias unit and the drill bit whereby the lateral bias applied by the modulated bias unit causes the drive unit to pivot about the fulcrum means so as to apply to the drill bit a lateral bias in the opposite direction to the bias applied to the drive unit by the bias unit.

5. A drilling assembly according to claim 1, wherein the modulated bias unit includes actuators that are located adjacent the drill bit so as to apply a lateral bias to the drill bit in the same direction as the lateral bias applied to the drive unit.

6. A drilling assembly according to claim 2, wherein the actuators of the modulated bias unit are located adjacent the drill bit so as to apply a lateral bias to the drill bit in the same direction as the lateral bias applied to the drive unit.

7. A drilling assembly according to claim 3, wherein the actuators of the modulated bias unit are located adjacent the drill bit so as to apply a lateral bias to the drill bit in the same direction as the lateral bias applied to the drive unit.

8. A drilling assembly according to claim 1, wherein the drill bit carries cutters located and orientated to perform cutting action on the formation as the drill bit rotates anti-clockwise relative thereto, the rotor of the drive unit being operatively coupled to the drill bit to rotate the drill bit anti-clockwise relative to the housing of the drive unit, and a hole opener being coupled to the drive unit for rotation therewith.

9. A drilling assembly according to claim 1, wherein the rotor of the drive unit is operatively coupled to the drill bit to rotate the drill bit in one direction relative to the housing of the drive unit, a hole opener is coupled to the housing of the drive unit for rotation therewith, and the rotor of a second drive unit is operatively coupled to the housing of the first drive unit to rotate the housing of the first drive unit in the opposite direction relative to the housing of the second drive unit.

10. A drilling assembly according to claim 1, comprising part of a bottom hole assembly for connection to the drill string, the bottom hole assembly further including at least one of: a thrust unit, a further hole opener, or a stabilizer.

* * * * *

UNITED STATES PATENT AND TRADEMARK OFFICE

CERTIFICATE OF CORRECTION

PATENT NO. : 5,778,992

DATED : July 14, 1998

INVENTOR(S) : John Michael Fuller

It is certified that error appears in the above-identified patent and that said Letters Patent is hereby corrected as shown below:

The title page, showing the illustrative figure, should be deleted and substitute therefor the attached title page.

Delete Figures 1, 2, and 3 and insert in their place Figures 1, 2, and 3 from the attached formal drawing.

Signed and Sealed this

Second Day of February, 1999

*Attest:*

*Acting Commissioner of Patents and Trademarks*

*Attesting Officer*

United States Patent [19]

Fuller

[11] Patent Number: 5,778,992

[45] Date of Patent: Jul. 14, 1998

[54] DRILLING ASSEMBLY FOR DRILLING HOLES IN SUBSURFACE FORMATIONS

[75] Inventor: John Michael Fuller, Nailsworth, England

[73] Assignee: Camco Drilling Group Limited of Hycalog, Stonehouse, England

[21] Appl. No.: 733,060

[22] Filed: Oct. 16, 1996

[30] Foreign Application Priority Data

Oct. 26, 1995 [GB] United Kingdom ..... 9521972

[51] Int. Cl.[6] ..... E21B 7/06

[52] U.S. Cl. ..... 175/73; 175/95; 175/406

[58] Field of Search ..... 175/73, 61, 107, 175/95, 96, 325.1, 101, 104, 406

[56] References Cited

U.S. PATENT DOCUMENTS

| | | | |
|---|---|---|---|
| 3,743,034 | 7/1973 | Bradley | 175/61 |
| 3,888,319 | 6/1975 | Bourne, Jr. et al. | 175/76 |
| 4,040,495 | 8/1977 | Kellner et al. | 175/73 |
| 4,185,704 | 1/1980 | Nixon | 175/76 |
| 4,262,758 | 4/1981 | Evans | 175/73 |
| 4,305,474 | 12/1981 | Farris et al. | 175/73 |
| 4,635,736 | 1/1987 | Shirley | 175/76 |
| 4,637,479 | 1/1987 | Leising | 175/61 X |
| 5,113,953 | 5/1992 | Noble | 175/61 |
| 5,265,682 | 11/1993 | Russell et al. | 175/73 X |
| 5,311,952 | 5/1994 | Eddison et al. | 175/61 |
| 5,314,030 | 5/1994 | Peterson et al. | 175/61 X |
| 5,343,964 | 9/1994 | Leroy | 175/61 |
| 5,452,772 | 9/1995 | Van Den Bergh | 175/107 X |
| 5,485,889 | 1/1996 | Gray | 175/61 |
| 5,490,569 | 2/1996 | Brotherton et al. | 175/61 |
| 5,520,255 | 5/1996 | Barr et al. | 175/24 |
| 5,547,031 | 8/1996 | Warren et al. | 175/61 |

FOREIGN PATENT DOCUMENTS

| | | |
|---|---|---|
| 0015137 | 9/1980 | European Pat. Off. . |
| 1514895 | 10/1989 | U.S.S.R. . |
| 2259316 | 3/1993 | United Kingdom . |
| 2306528 | 5/1997 | United Kingdom . |
| 9007625 | 7/1990 | WIPO . |

*Primary Examiner*—Hoang C. Dang

[57] ABSTRACT

A drilling assembly for drilling holes in subsurface formations comprises a drill bit 10, a drive unit 12 including a housing and a rotor 11 operatively coupled to the drill bit to rotate the drill bit relative to the housing, and a modulated bias unit 14 coupled to rotate with the drive unit housing and apply a lateral bias thereto in synchronism with rotation of the housing. The modulated bias unit 14 comprises one or more hydraulic actuators including members 16 which, in use, bear against the sides of the borehole, and means for modulating the pressure of fluid supplied to the actuators in synchronism with rotation of a component of the drilling assembly, and in selected angular phase relation thereto, whereby each hydraulic actuator is actuated in a selected rotational position of the component.

10 Claims, 1 Drawing Sheet

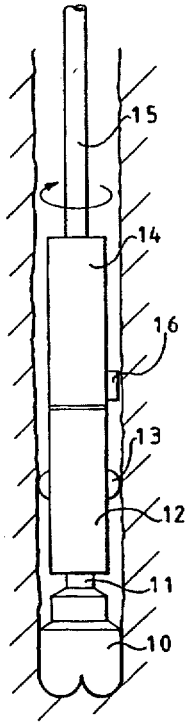

FIG 1
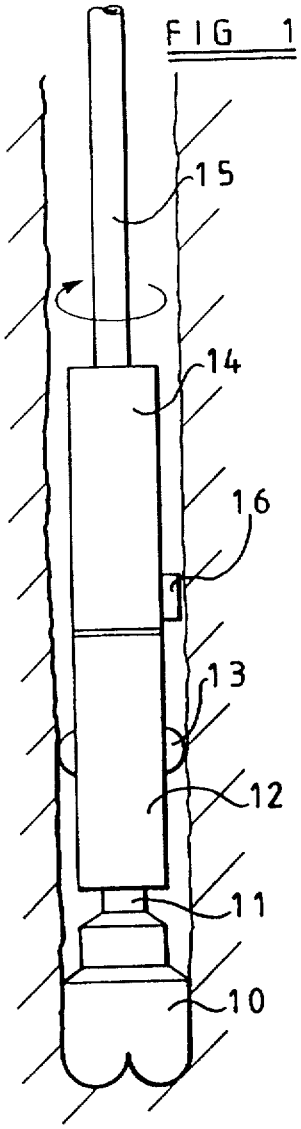
FIG 2
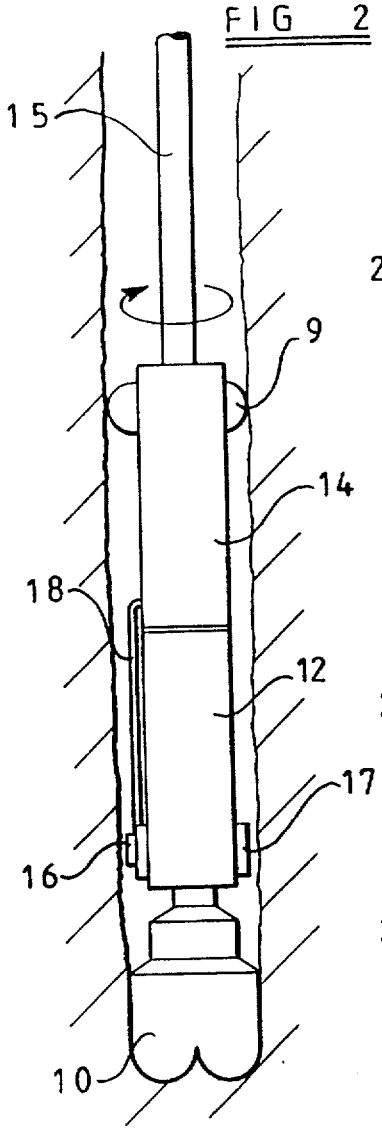
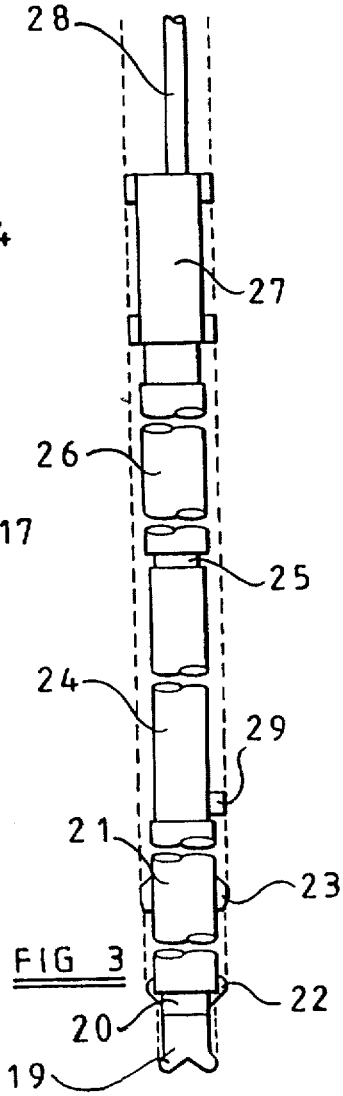
FIG 3